US007705228B2

(12) United States Patent
Hilliard et al.

(10) Patent No.: US 7,705,228 B2
(45) Date of Patent: Apr. 27, 2010

(54) SHOULDER MARCHING TUBA

(75) Inventors: Gregory Hilliard, Delavin, WI (US); Michael Kamphuis, Three Rivers, MI (US)

(73) Assignee: Conn-Selmer, Inc., Elkhart, IN (US)

( * ) Notice: Subject to any disclaimer, the term of this patent is extended or adjusted under 35 U.S.C. 154(b) by 223 days.

(21) Appl. No.: 11/948,068

(22) Filed: Nov. 30, 2007

(65) Prior Publication Data

US 2008/0092719 A1 Apr. 24, 2008

Related U.S. Application Data

(60) Provisional application No. 60/868,146, filed on Dec. 1, 2006.

(51) Int. Cl.
*G10D 9/00* (2006.01)
*G10D 9/04* (2006.01)

(52) U.S. Cl. ..... 84/388; 84/330; 84/387 R; 84/391

(58) Field of Classification Search ..... 84/388
See application file for complete search history.

(56) References Cited

U.S. PATENT DOCUMENTS 673,983 A 5/1901 Harrison
1,662,076 A 3/1928 Newman
2,093,993 A 9/1937 Adriani
2,738,696 A 3/1956 Ritterbach
3,161,103 A 12/1964 Pascucci et al.
3,933,079 A 1/1976 Gillespie
4,276,804 A 7/1981 Holland
4,831,911 A * 5/1989 Wanner ..... 84/395
5,287,785 A 2/1994 Miller
5,435,222 A 7/1995 Leonard
5,834,666 A 11/1998 Wanner et al.
7,161,077 B1 * 1/2007 Fry et al. ..... 84/387 R

* cited by examiner

*Primary Examiner*—Jeffrey Donels
*Assistant Examiner*—Christopher Uhlir
(74) *Attorney, Agent, or Firm*—Fish & Richardson P.C.

(57) ABSTRACT

A shoulder marching tuba having a compact slide arrangement for instrument spot tuning. The shoulder marching tuba includes an air inlet mouthpiece, an air outlet bell, and a series of airflow tubing and valves in fluid communication therebetween. The series of airflow tubing and valves include at least four pairs of tubes in sliding, telescoping engagement, wherein the four pairs of tubes are mounted in parallel arrangement and in sequential fluid communication. The first tubes of each of the four pairs of tubes are secured in a first bundle the second tubes of each of the four pairs of tubes are secured in a second bundle. One of the first bundle and the second bundle is mounted for sliding movement relative to the other of the first bundle and the second bundle for adjustment of musical pitch of sound issued from the shoulder marching tuba.

9 Claims, 8 Drawing Sheets

SHOULDER MARCHING TUBA

CROSS-REFERENCE TO RELATED APPLICATIONS

This U.S. patent application claims priority under 35 U.S.C. §119(e) to a U.S. provisional patent application 60/868,146, filed on Dec. 1, 2006, the entire contents of which are hereby incorporated by reference.

TECHNICAL FIELD

This invention relates to musical instruments, and more particularly to shoulder marching tuba musical instruments.

BACKGROUND

Brass instruments typically have a slide arrangement for quick, spot tuning. On larger volume instruments, such as tubas, a lengthy slide arrangement is required. This works for concert tubas, but not for shoulder marching tubas, which are held in a different, relatively unwieldy position. As a result, shoulder marching tubas are typically built without a slide, instead requiring the player to overcome tuning issues by varying his or her embouchure (lip shape) to pull a note into tune.

SUMMARY

In one aspect, a shoulder marching tuba includes an air inlet mouthpiece, an air outlet bell, and a series of airflow tubing and valves in fluid communication therebetween. The series of airflow tubing and valves include at least four pairs of tubes in sliding, telescoping engagement, wherein the four pairs of tubes are mounted in parallel arrangement and in sequential fluid communication. The first tubes of each of the four pairs of tubes are secured in a first bundle and the second tubes of each of the four pairs of tubes are secured in a second bundle. One of the first bundle and the second bundle is mounted for sliding movement relative to the other of the first bundle and the second bundle to permit adjustment of musical pitch of sound issued from the shoulder marching tuba.

In another aspect, the shoulder marching tuba includes first, second, and third valve systems. A first substantially U-shaped stationary tube has first and second ends. The first valve system is in fluid communication with the second end of the first substantially U-shaped stationary tube. The first valve system includes a first valve and a slide assembly in fluid communication with the first valve. The slide assembly includes first and second substantially U-shaped slide tubes, each having first and second legs, and third and fourth substantially U-shaped slide tubes, each having first and second legs. The first and second legs of the first and second substantially U-shaped slide tubes slidably engage the first and second legs of the third and fourth substantially U-shaped slide tubes. In one example, the third substantially U-shaped slide tube is secured to the fourth substantially U-shaped slide tube to provide mutual support and maintain alignment of the slide tubes.

The following arrangement of the slide tubes provides a variable length tube system in fluid communication with the first valve. The first leg of the first substantially U-shaped slide tube slidably engages the first leg of the fourth substantially U-shaped slide tube. The second leg of the first substantially U-shaped slide tube slidably engages the second leg of the third substantially U-shaped slide tube. The first leg of the second substantially U-shaped slide tube slidably engages the first leg of the third substantially U-shaped slide tube. The second leg of the second substantially U-shaped slide tube slidably engages the second leg of the fourth substantially U-shaped slide tube.

The second valve system is in fluid communication with the first valve system. The second valve system includes a second valve and a second substantially U-shaped stationary tube having first and second ends, both in fluid communication with the second valve. In one example, the second substantially U-shaped stationary tube further includes a crook and first and second legs joining the crook to the second valve. The first and second legs are curved to position the crook along side the slide assembly.

The third valve system is in fluid communication with the second valve system. The third valve system includes a third valve and a third substantially U-shaped stationary tube having first and second ends, both in fluid communication with the third valve. In one example, the third substantially U-shaped stationary tube further includes a crook and first and second legs, which are both in fluid communication with the crook. First and second curved ends join the first and second legs, respectively, to the third valve such that the first and second legs of the third substantially U-shaped stationary tube are substantially parallel to the slide assembly.

A fourth substantially U-shaped stationary tube has first and second ends. The second end is in fluid communication with the first end of the first substantially U-shaped stationary tube. A mouth piece is in fluid communication with the first end of the fourth substantially U-shaped stationary tube.

Fifth, sixth, seventh, and eighth substantially U-shaped stationary tubes, each having first and second ends, are in fluid communication to form a series of tubing between the third valve and a bell. The first end of the fifth substantially U-shaped stationary tube is in fluid communication with the third valve. The first end of the sixth substantially U-shaped stationary tube is in fluid communication with the second end of the fifth substantially U-shaped stationary tube. The first end of the seventh substantially U-shaped stationary tube is in fluid communication with the second end of the sixth substantially U-shaped stationary tube. The first end of the eighth substantially U-shaped stationary tube is in fluid communication with the second end of the seventh substantially U-shaped stationary tube. Finally, the bell is in fluid communication with the second end of the eighth substantially U-shaped stationary tube.

In one example, the first and second substantially U-shaped slide tubes are associated for simultaneous movement. This allows a user to control the variable length of the slide assembly by moving the first and second substantially U-shaped slide tubes in unison, rather than independently.

In another example, a first brace is secured between the first and second legs of the first substantially U-shaped stationary tube in a manner to hold both legs substantially parallel. Similarly, in another instance, a second brace is secured between the first leg of the first substantially U-shaped stationary tube and the third valve in a manner to hold the first and second legs of the first substantially U-shaped stationary tube substantially parallel.

A user of the shoulder marching tuba is benefited by means for holding the apparatus and actuating the slide assembly. In one implementation, the tuba includes first, second, and third rings which may be configured for engagement by the user's fingers. A first ring is mounted upon the first substantially U-shaped slide tube; a second ring is mounted upon the second substantially U-shaped stationary tube; and a third ring mounted upon the fourth substantially U-shaped stationary tube. A user may move the first and second rings relative to each other to alter the effective length of the slide assembly.

To provide ergonomic placement of a user's head in relation to the tuba, in another example, the tuba includes a mouthpiece tube having first and second ends, where the second end of the mouthpiece tube is in fluid communication with the first end of the fourth substantially U-shaped stationary tube. The first end of the mouthpiece tube is in fluid communication with the mouthpiece.

The details of one or more implementations of the disclosure are set in the accompanying drawings and the description below. Other features, objects, and advantages will be apparent from the description and drawings, and from the claims.

DESCRIPTION OF DRAWINGS

Like reference symbols in the various drawings indicate like elements.

DETAILED DESCRIPTION

Figure 1:
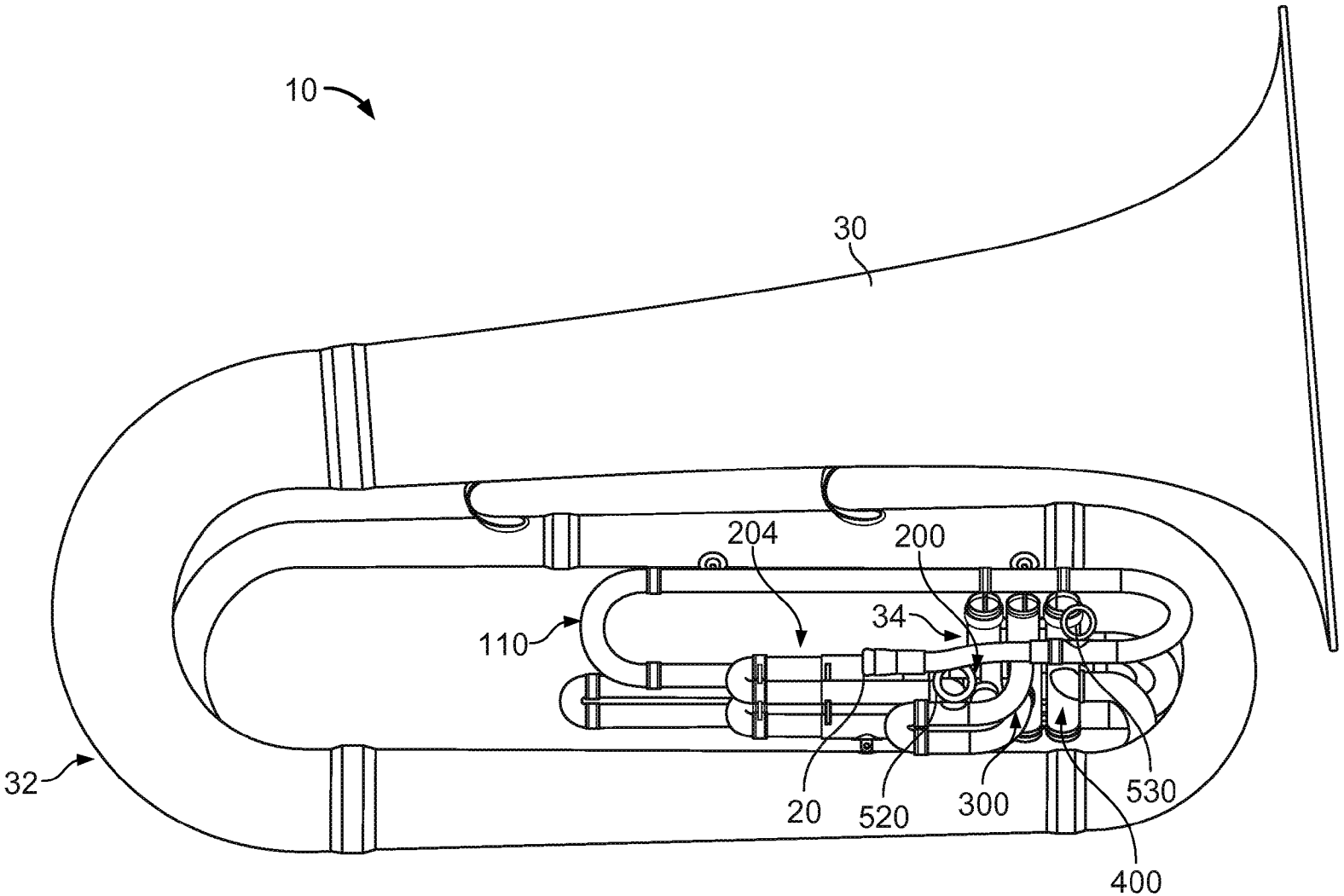
FIG. 1 is a side view of a shoulder marching tuba.
Figure 2:
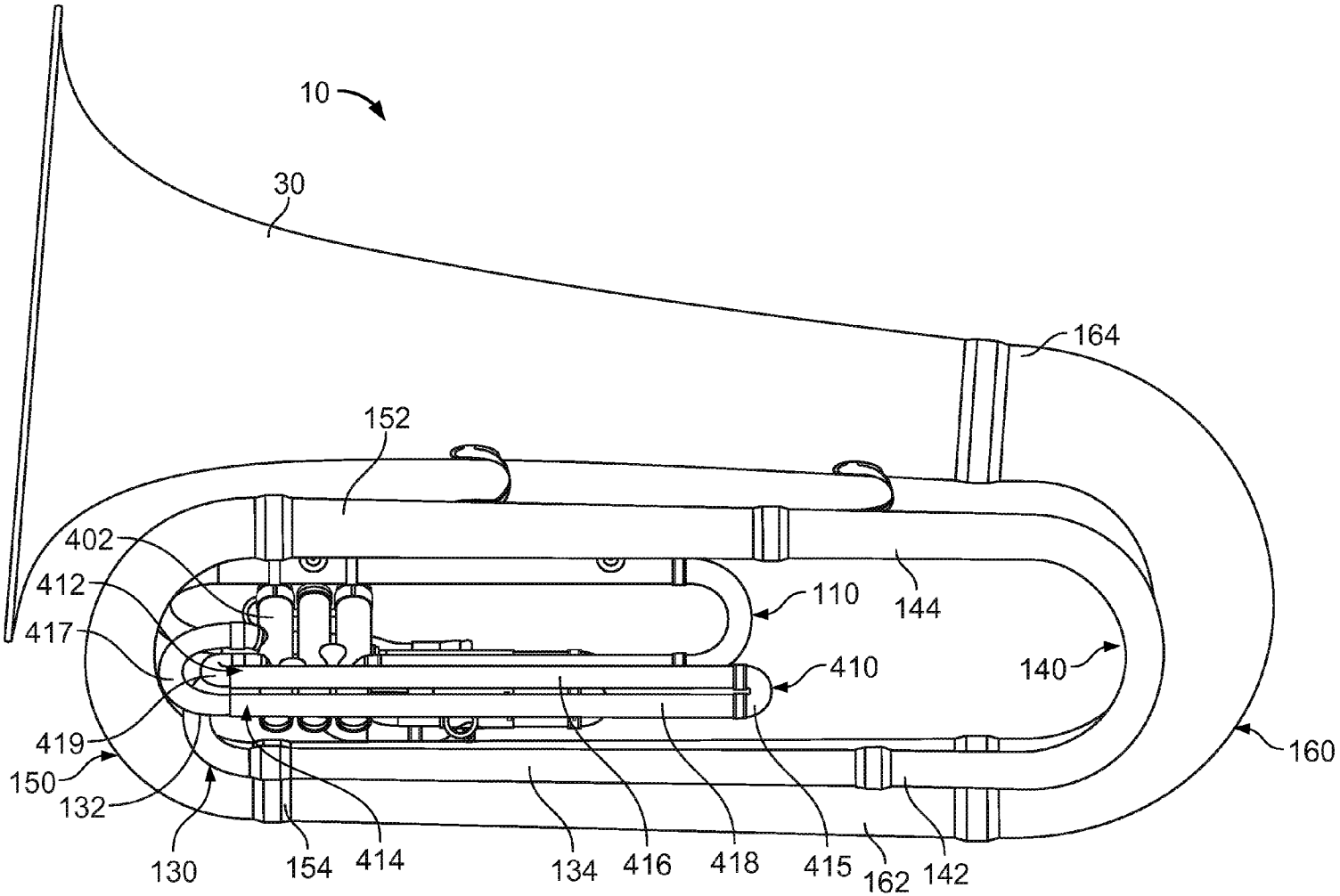
FIG. 2 is a side view of a shoulder marching tuba.
Figure 3:
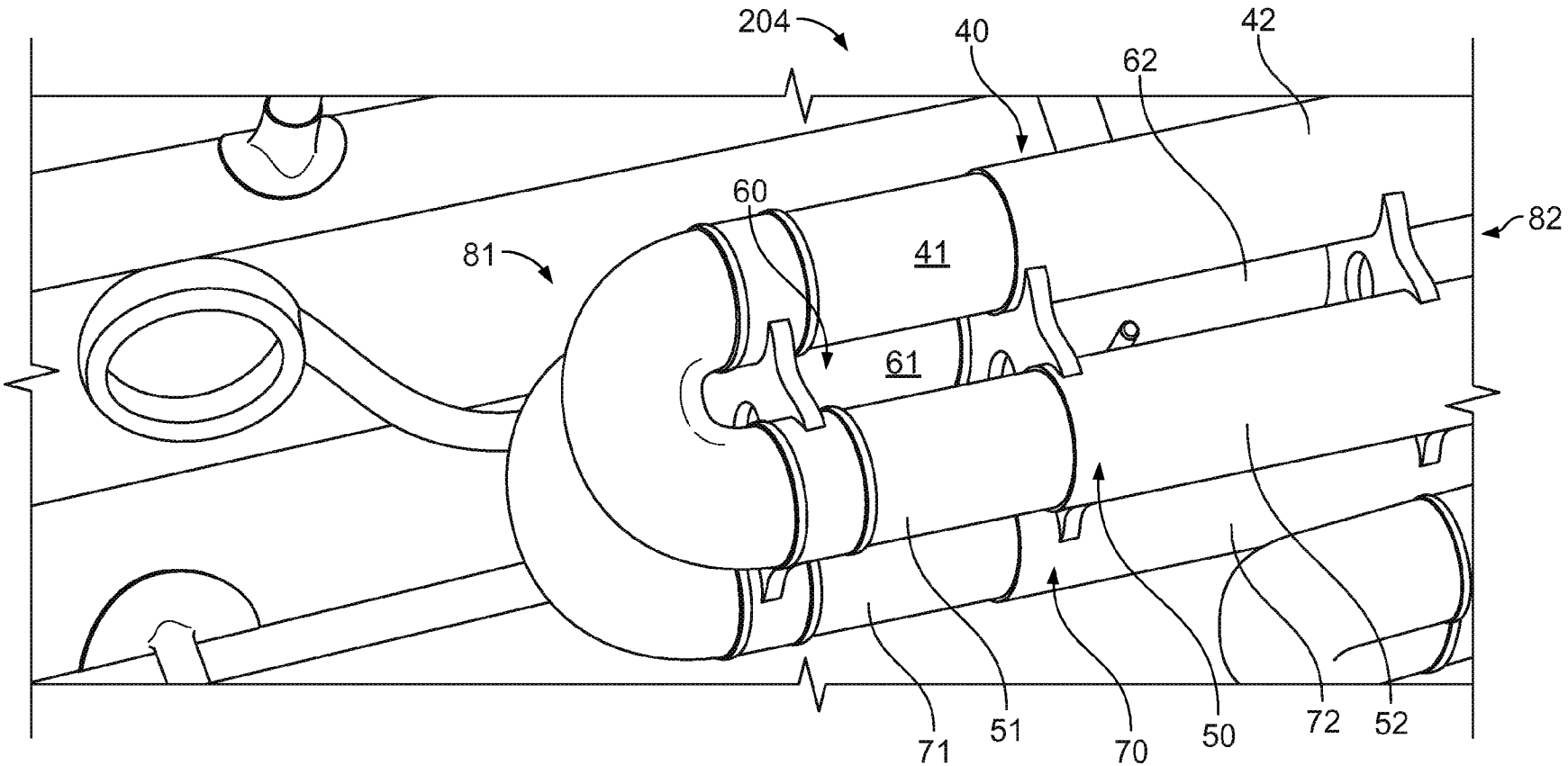
FIG. 3 is a perspective view of a slide assembly of a shoulder marching tuba.

A shoulder marching tuba has a compact slide arrangement permitting spot tuning of the instrument. Referring to FIG. 1-3, shoulder marching tuba 10 includes air inlet mouthpiece 20, air outlet bell 30, and a series of airflow tubing 32 and valves 34 in fluid communication therebetween. The series of airflow tubing 32 and valves 34 include at least four pairs of tubes 40, 50, 60, and 70, respectively, in sliding, telescoping engagement, the four pairs of tubes 40, 50, 60, and 70, respectively, mounted in parallel arrangement and in sequential fluid communication. The first tubes 41, 51, 61, and 71, respectively, of the four pairs of tubes 40, 50, 60, and 70, respectively, are secured in a first bundle 81 and the second tubes 42, 52, 62, and 72, respectively, of the four pairs of tubes 40, 50, 60, and 70, respectively, are secured in a second bundle 82. One of the first bundle 81 and the second bundle 82 is mounted for sliding movement relative to the other of the first bundle 81 and the second bundle 82 for adjustment of musical pitch of sound issued from shoulder marching tuba 10.

On a trumpet and other relatively smaller brass instruments, there are "slip slides" that are put in motion while playing for adjustment of pitch, but they consist of two inner slides, a return bow, and two outer slides. This works well on a trumpet, because the length of adjustment required to pull a note back into tune is relatively short. On a tuba, the length of adjustment required is relatively long for a two tube slide, which would make it unwieldy for a player to use effectively while marching. In contrast, the path of the air flow tubes of the shoulder marching tuba 10 of the disclose is doubled up, utilizing four pairs of slide tubes 40, 50, 60, and 70, respectively, providing a relatively shorter adjustment length. In one example, adjusting the four pairs of slide tubes 40, 50, 60, and 70, respectively, by a distance of two inches is equivalent to adjusting a two tube slide a distance of four inches.

On a concert tuba the length of adjustment is not a particular impediment due to the position in which a concert instrument is held. However, instrument spot tuning of shoulder marching tubas without adjustable slides requires players to change their embouchure (lip shape) to pull notes into tune, which requires a degree of expertise not possessed by players of all levels, often resulting in an adverse effect on sound quality.

Figure 4:
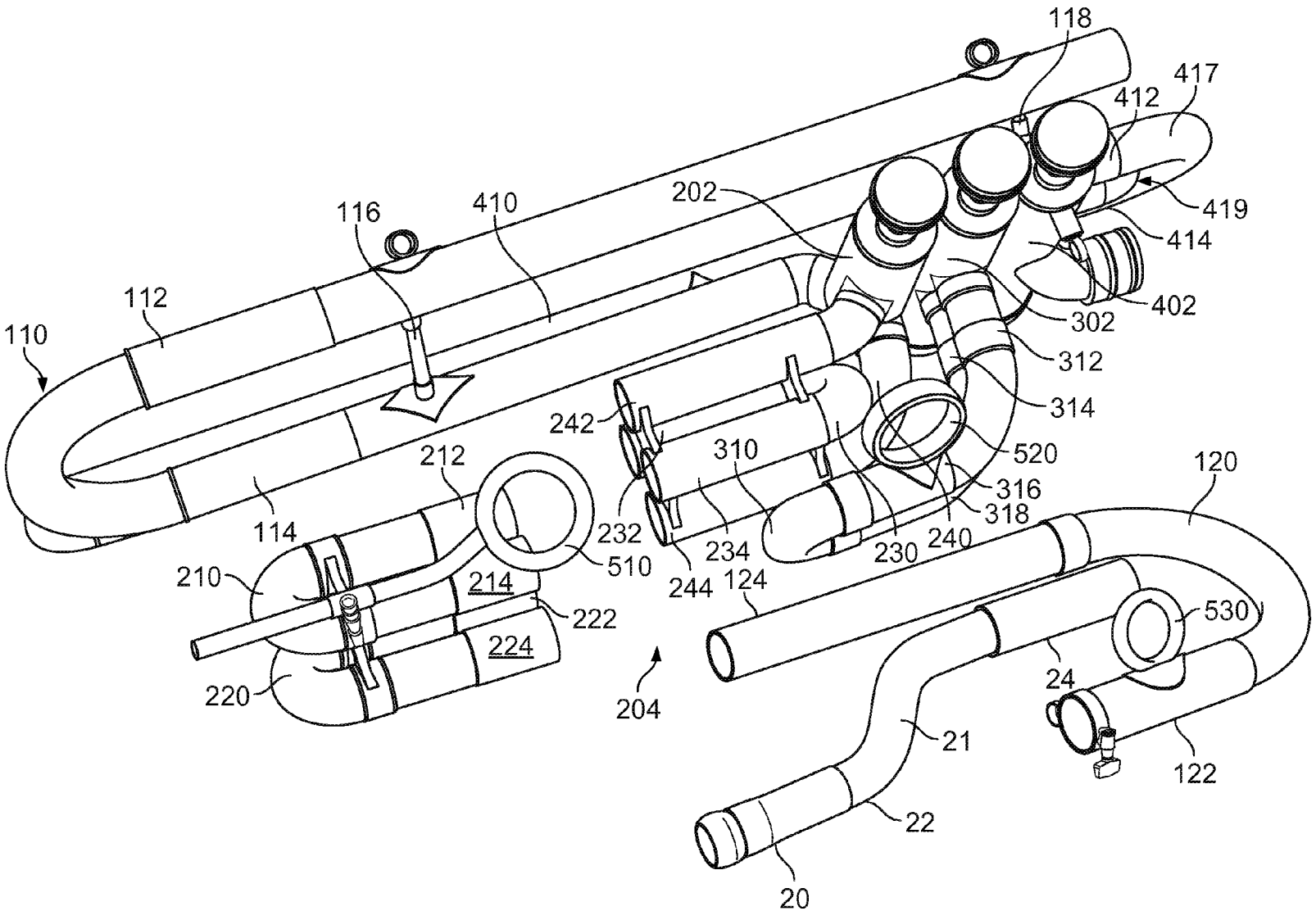
FIG. 4 is an exploded view of a first, second, and third valve systems of a shoulder marching tuba.
Figure 5:
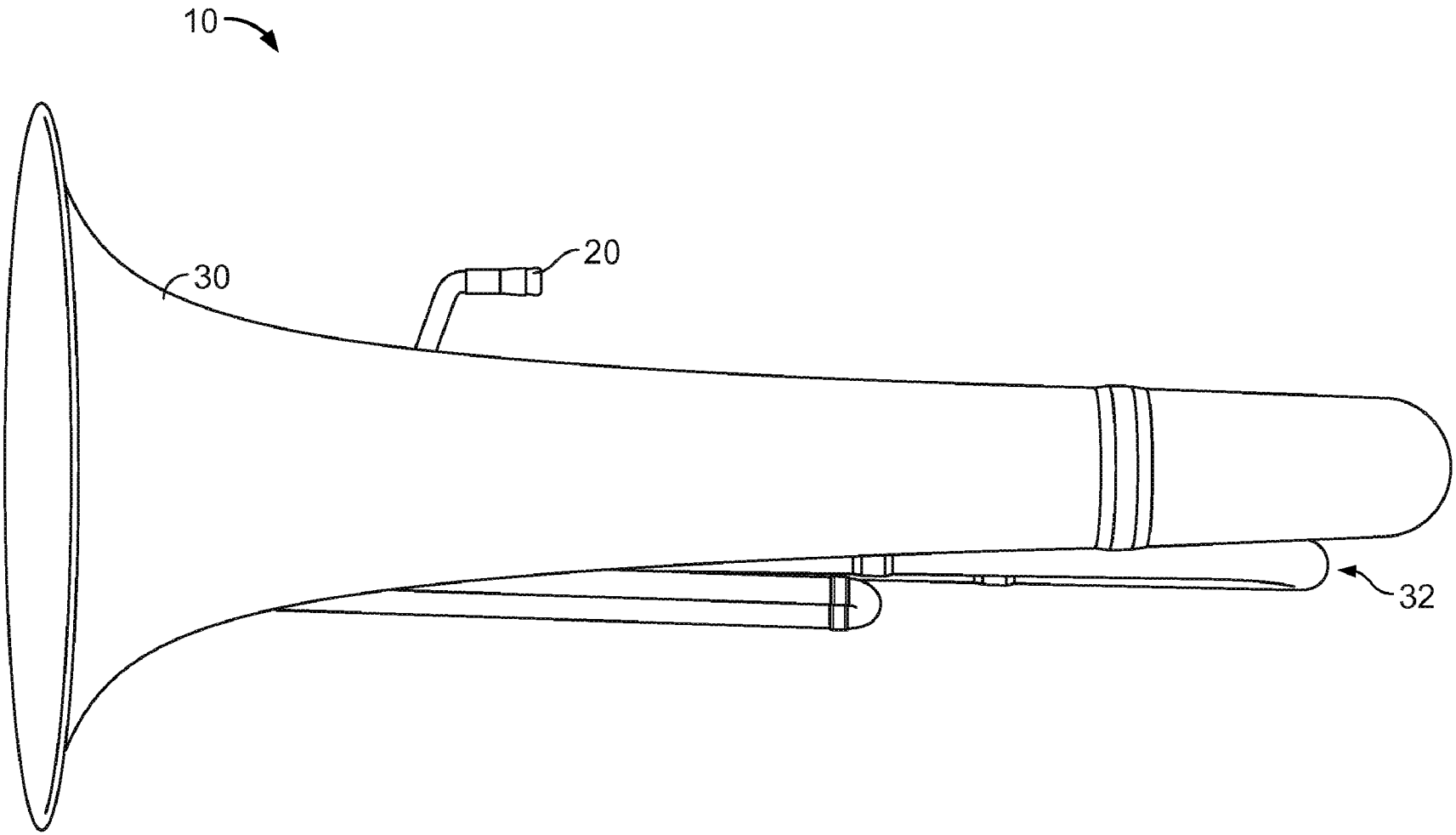
FIG. 5 is a top view of a shoulder marching tuba.

Referring to FIGS. 1, 2, and 4, another example of a shoulder marching tuba 10 includes first, second, and third valve systems 200, 300, and 400, respectively. First substantially U-shaped stationary tube 110 has first and second ends 112 and 114, respectively. First valve system 200 is in fluid communication with the second end 114 of first substantially U-shaped stationary tube 110. First valve system 200 includes first valve 202 and slide assembly 204 in fluid communication with first valve 202. Slide assembly 204 includes first and second substantially U-shaped slide tubes, 210 and 220 respectively, each having first and second legs 212, 214 and 222, 224, respectively. Slide assembly 204 also includes third and fourth substantially U-shaped slide tubes 230 and 240, respectively, each having first and second legs 232, 234 and 242, 244, respectively.

The first legs 212 and 222, respectively, of first and second substantially U-shaped slide tubes 210 and 220, respectively, slidably engage the first legs 232 and 242, respectively, of third and fourth substantially U-shaped slide tubes 230 and 240, respectively. Similarly, the second legs 214 and 224, respectively, of first and second substantially U-shaped slide tubes 210 and 220, respectively, slidably engage the second legs 234 and 244, respectively, of third and fourth substantially U-shaped slide tubes 230 and 240, respectively. In one example, third substantially U-shaped slide tube 230 is secured to fourth substantially U-shaped slide tube 240 to provide mutual support and maintain alignment of the slide tubes.

The following arrangement of the slide tubes provides a variable length tube system in fluid communication with first valve 202. The first leg 212 of first substantially U-shaped slide tube 210 slidably engages the first leg 242 of fourth substantially U-shaped slide tube 240. The second leg 214 of first substantially U-shaped slide tube 210 slidably engages the second leg 234 of third substantially U-shaped slide tube 230. The first leg 222 of second substantially U-shaped slide tube 220 slidably engages the first leg 232 of third substantially U-shaped slide tube 230. The second leg 224 of second substantially U-shaped slide tube 220 slidably engages the second leg 244 of fourth substantially U-shaped slide tube 240.

Second valve system 300 is in fluid communication with first valve system 200. Second valve system 300 includes second valve 302 and second substantially U-shaped stationary tube 310 having first and second ends 312 and 314, respectively, both in fluid communication with second valve 302. In one example, second substantially U-shaped stationary tube 310 further includes crook 315 and first and second legs 316 and 318, respectively, which join crook 315 to second valve 302. First and second legs 316 and 318, respectively, of second substantially U-shaped stationary tube 310 are curved to position crook 315 along side slide assembly 204.

Third valve system 400 is in fluid communication with second valve system 300. Third valve system includes third valve 402 and third substantially U-shaped stationary tube 410 having first and second ends 412 and 414, respectively, both in fluid communication with third valve 402. In one example, third substantially U-shaped stationary tube 410 further includes crook 415 and first and second legs 416 and 418, respectively, both in fluid communication with crook 415. First and second curved ends 417 and 419, respectively, join first and second legs 416 and 418, respectively, to third valve 402, such that first and second legs 416 and 418, respectively, of third substantially U-shaped stationary tube 410 are substantially parallel to slide assembly 204.

Fourth substantially U-shaped stationary tube 120 has first and second ends 122 and 124, respectively. The second end 124 is in fluid communication with the first end 112 of first substantially U-shaped stationary tube 110. Mouth piece 20 is in fluid communication with the first end 122 of fourth substantially U-shaped stationary tube 120.

Referring to FIGS. 1-2 and 7-8, fifth, sixth, seventh, and eighth substantially U-shaped stationary tubes 130, 140, 150, and 160, respectively, are in fluid communication to form a series of tubing between third valve 402 and bell 30. Fifth substantially U-shaped stationary tube 130 has first and second ends 132 and 134, respectively. The first end 132 is in fluid communication with third valve 402. Sixth substantially U-shaped stationary tube 140 has first and second ends 142 and 144, respectively. The first end 142 is in fluid communication with the second end 134 of fifth substantially U-shaped stationary tube 130. Seventh substantially U-shaped stationary tube 150 has first and second ends 152 and 154, respectively. The first end 152 is in fluid communication with the second end 144 of sixth substantially U-shaped stationary tube 140. Eighth substantially U-shaped stationary tube 160 has first and second ends 162 and 164, respectively. The first end 162 is in fluid communication with the second end 154 of seventh substantially U-shaped stationary tube 150. Bell 30 is in fluid communication with the second end 164 of eighth substantially U-shaped stationary tube 160.

In one example, first and second substantially U-shaped slide tubes 210 and 220, respectively, are associated for simultaneous movement. This allows a user to control the variable length of slide assembly 204 by moving first and second substantially U-shaped slide tubes 210 and 220, respectively, in unison, rather than independently.

In another example, shoulder marching tuba 10 includes first brace 116 secured between the first and second legs 112 and 114, respectively, of first substantially U-shaped stationary tube 110 in a manner to hold both legs substantially parallel. Similarly, in a further embodiment, tuba 10 includes a second brace 118 secured between the first leg 112 of first substantially U-shaped stationary tube 110 and third valve 402 in a manner to hold the first and second legs 112 and 114, respectively, of first substantially U-shaped stationary tube 110 substantially parallel.

A user of tuba 10 is benefited by first, second, and third rings 510, 520, and 530, respectively, as shown in FIGS. 1 and 4, e.g. for holding the apparatus and actuating the slide assembly 204. First ring 510 is mounted upon first substantially U-shaped slide tube 210. Second ring 520 is mounted upon second substantially U-shaped stationary tube 310. Third ring 530 is mounted upon fourth substantially U-shaped stationary tube 120. A user may move first and second rings 510 and 520, respectively, in relation to each other to alter an effective length of slide assembly 204.

Figure 6:
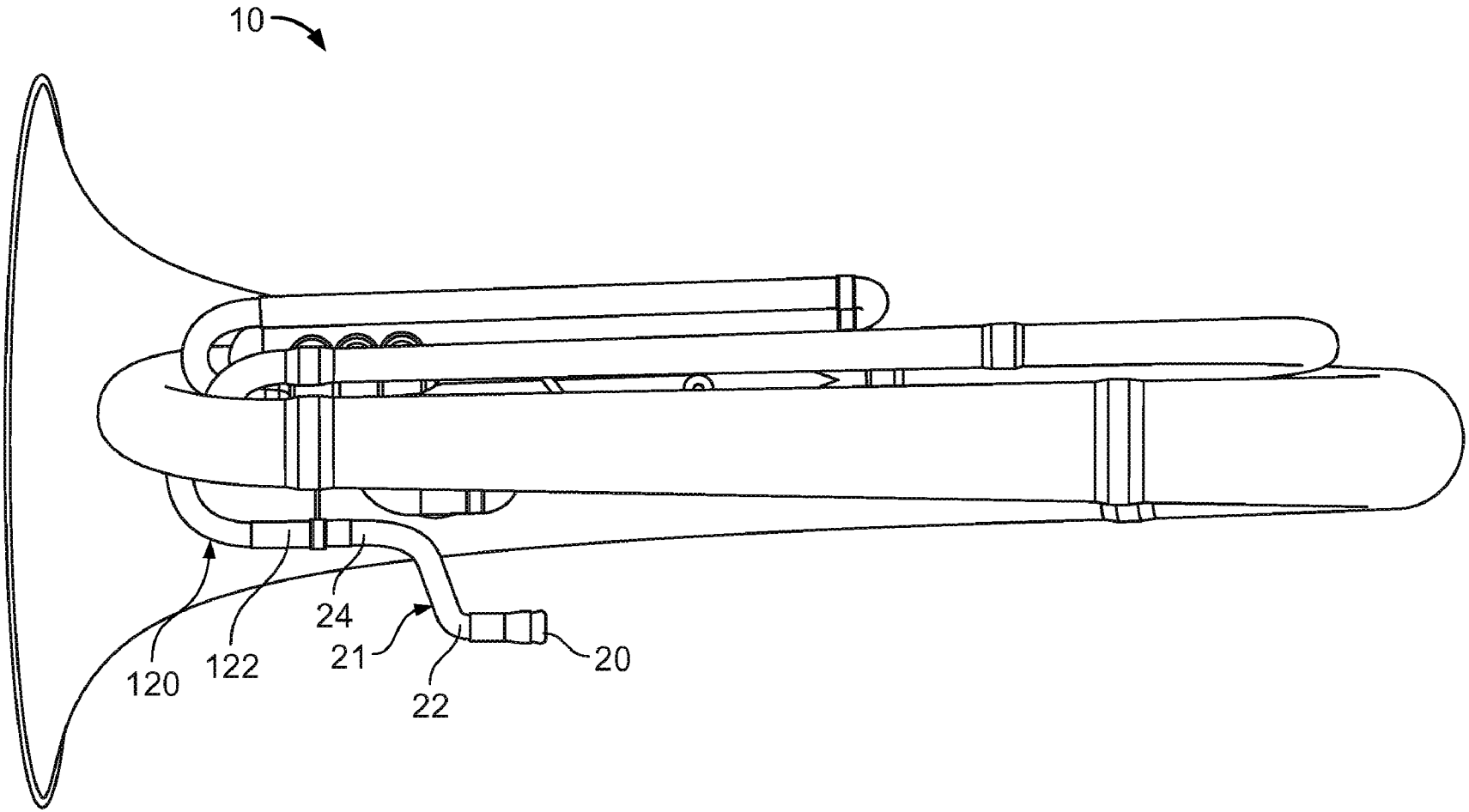
FIG. 6 is a bottom view of a shoulder marching tuba.
Figure 7:
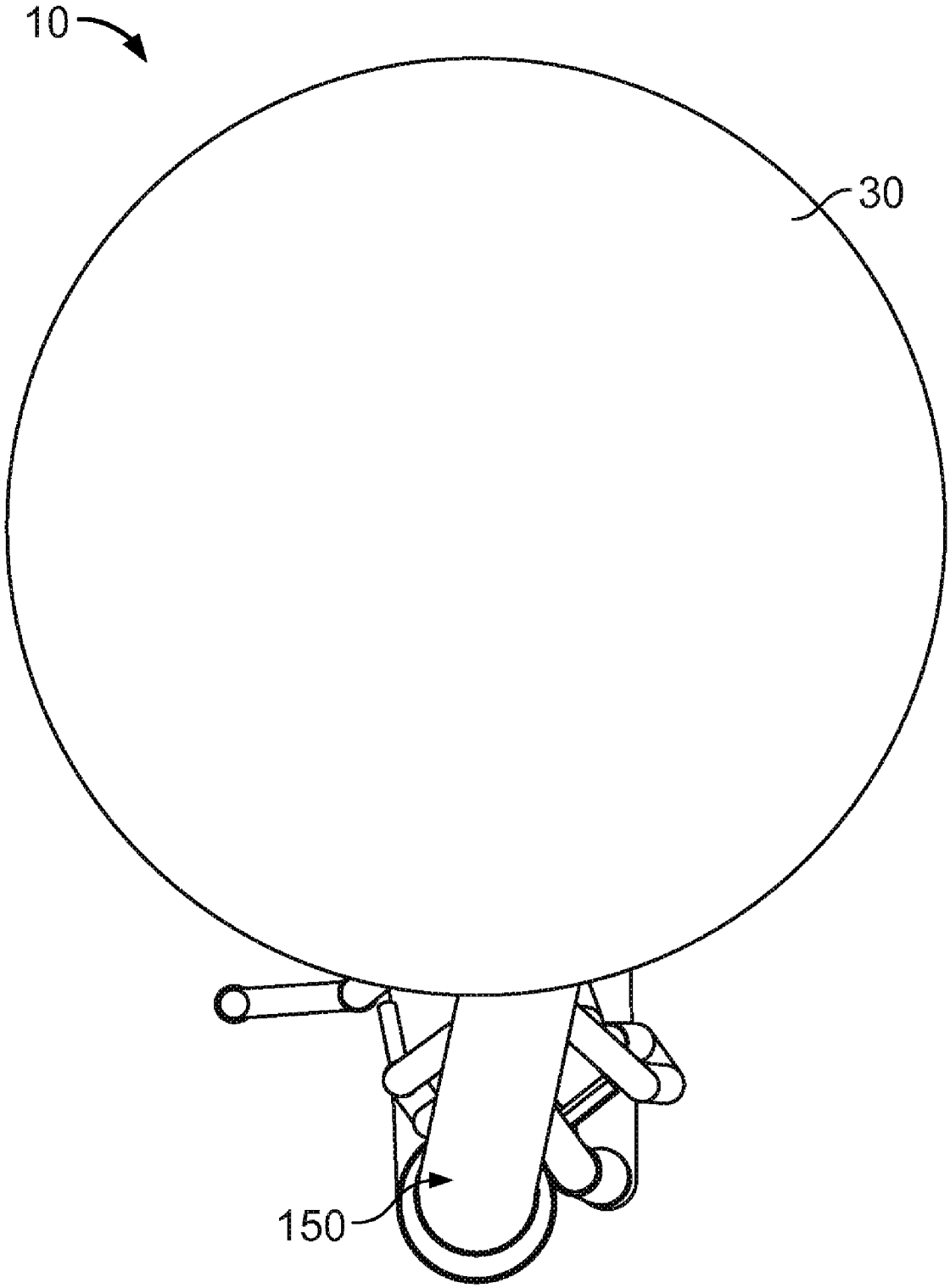
FIG. 7 is a front view of a shoulder marching tuba.
Figure 8:
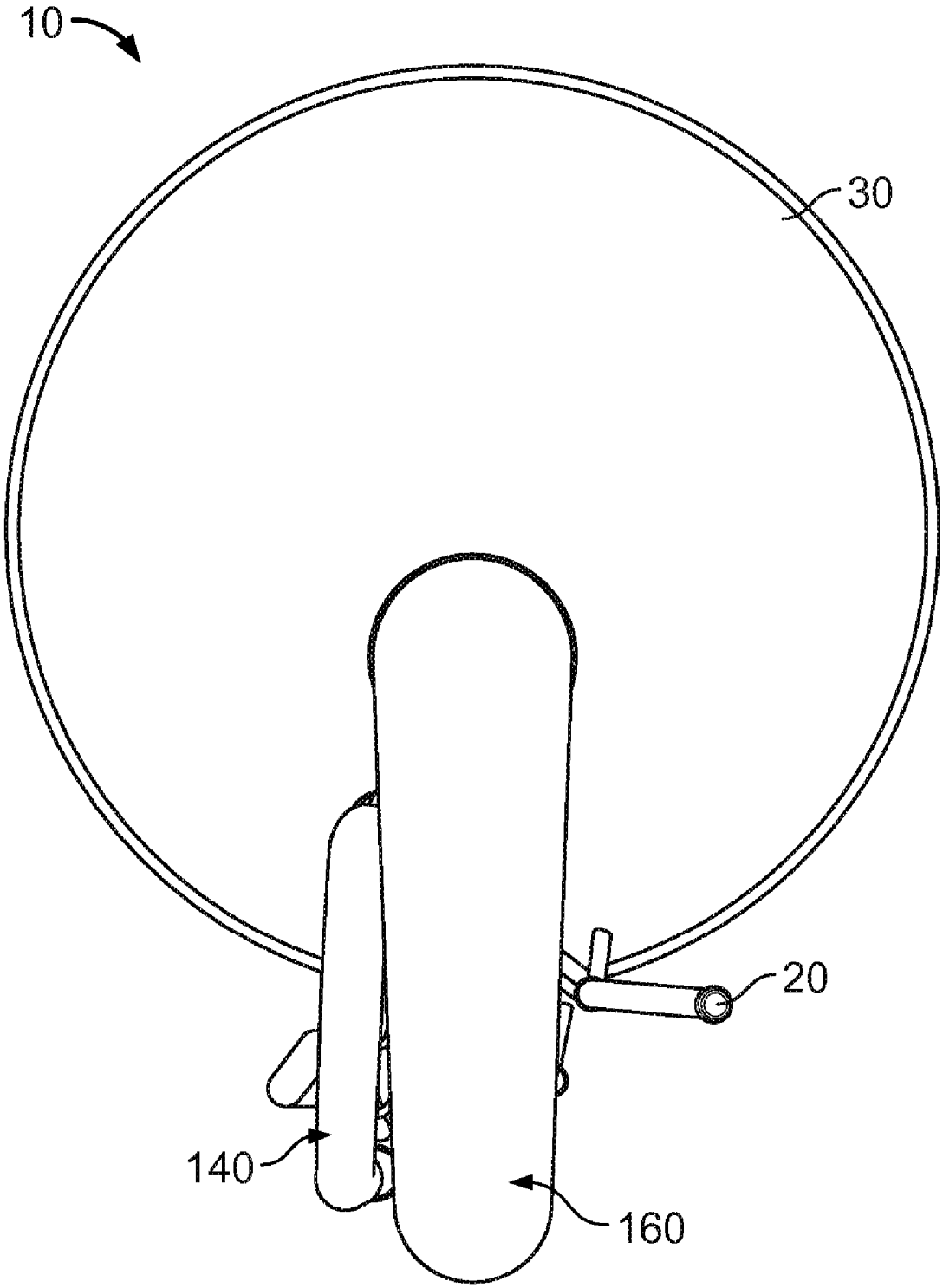
FIG. 8 is a rear view of a shoulder marching tuba.

FIG. 6 provides a bottom view of a shoulder marching tuba 10. To provide ergonomic placement of a head of a user in relation to tuba 10, in another example, tuba 10 includes mouthpiece tube 21 having first and second ends 22 and 24, respectively. The second end 24 of mouthpiece tube 21 is in fluid communication with the first end 122 of fourth substantially U-shaped stationary tube 120. The first end 22 of mouthpiece tube 21 is in fluid communication with mouthpiece 20.

A number of implementations have been described. Nevertheless, it will be understood that various modifications may be made without departing from the spirit and scope of the disclosure. Accordingly, other implementations are within the scope of the following claims.

What is claimed is:

1. A shoulder marching tuba comprising:

a first substantially U-shaped stationary tube having a first end and a second end;

a first valve system in fluid communication with the second end of the first substantially U-shaped stationary tube, the first valve system comprising:

a first valve;

a slide assembly in fluid communication with the first valve, the slide assembly comprising:

first and second substantially U-shaped slide tubes, each having first and second legs;

third and fourth substantially U-shaped slide tubes, each having first and second legs;

the first and second legs of the first and second substantially U-shaped slide tubes slidably engaging the first and second legs of the third and fourth substantially U- shaped slide tubes;

wherein the first leg of the first substantially U-shaped slide tube slidably engages the first leg of the fourth substantially U-shaped slide tube;

wherein the second leg of the first substantially U-shaped slide tube slidably engages the second leg of the third substantially U-shaped slide tube;

wherein the first leg of the second substantially U-shaped slide tube slidably engages the first leg of the third substantially U-shaped slide tube; and wherein the second leg of the second substantially U-shaped slide tube slidably engages the second leg of the fourth substantially U-shaped slide tube;

a second valve system in fluid communication with the first valve system, the second valve system comprising:

a second valve; and a second substantially U-shaped stationary tube having first and second ends, both in fluid communication with the second valve;

a third valve system in fluid communication with the second valve system, the third valve system comprising:

a third valve; and a third substantially U-shaped stationary tube having first and second ends, both in fluid communication with the third valve;

a fourth substantially U-shaped stationary tube having first and second ends, the second end in fluid communication with the first end of the first substantially U-shaped stationary tube;

a mouth piece in fluid communication with the first end of the fourth substantially U-shaped stationary tube;

a fifth substantially U-shaped stationary tube having first and second ends, the first end in fluid communication with the third valve;

a sixth substantially U-shaped stationary tube having first and second ends, the first end in fluid communication with the second end of the fifth substantially U-shaped stationary tube;

a seventh substantially U-shaped stationary tube having first and second ends, the first end in fluid communication with the second end of the sixth substantially U-shaped stationary tube;

a eighth substantially U-shaped stationary tube having first and second ends, the first end in fluid communication with the second end of the seventh substantially U-shaped stationary tube; and a bell in fluid communication with the second end of the eighth substantially U-shaped stationary tube.

2. The shoulder marching tuba of claim 1 wherein the third substantially U-shaped slide tube is secured to the fourth substantially U-shaped slide tube.

3. The shoulder marching tuba of claim 1 further comprising a first brace secured between the first and second legs of the first substantially U-shaped stationary tube in a manner to hold both legs substantially parallel.

4. The shoulder marching tuba of claim 3 further comprising a second brace secured between the first leg of the first substantially U-shaped stationary tube and the third valve in a manner to hold the first and second legs of the first substantially U-shaped stationary tube substantially parallel.

5. The shoulder marching tuba of claim 1 wherein the second substantially U-shaped stationary tube further comprises:

a crook; and first and second legs joining the crook to the second valve and curved to position the crook along side the slide assembly.

6. The shoulder marching tuba of claim 1 wherein the third substantially U-shaped stationary tube further comprises:

a crook;

first and second legs, both in fluid communication with the crook; and first and second curved ends joining the first and second legs, respectively, to the third valve, wherein the first and second legs of the third substantially U-shaped stationary tube are substantially parallel to the slide assembly.

7. The shoulder marching tuba of claim 1 further comprising:

a first ring mounted upon the first substantially U-shaped slide tube;

a second ring mounted upon the second substantially U-shaped stationary tube; and a third ring mounted upon the fourth substantially U-shaped stationary tube.

8. The shoulder marching tuba of claim 1 further comprising a mouthpiece tube having first and second ends, the second end of the mouthpiece tube in fluid communication with the first end of the fourth substantially U-shaped stationary tube; the first end of the mouthpiece tube in fluid communication with the mouthpiece.

9. The shoulder marching tuba of claim 1 wherein the first and second substantially U-shaped slide tubes are associated for simultaneous movement.

* * * * *